US008910392B2

(12) United States Patent
Liao

(10) Patent No.: US 8,910,392 B2
(45) Date of Patent: Dec. 16, 2014

(54) DEWATERING MACHINE FOR UMBRELLA

(76) Inventor: Zhifeng Liao, Guangzhou (CN)

( * ) Notice: Subject to any disclaimer, the term of this patent is extended or adjusted under 35 U.S.C. 154(b) by 209 days.

(21) Appl. No.: 13/578,239

(22) PCT Filed: Dec. 15, 2010

(86) PCT No.: PCT/CN2010/079799

§ 371 (c)(1),
(2), (4) Date: Aug. 9, 2012

(87) PCT Pub. No.: WO2011/097918

PCT Pub. Date: Aug. 18, 2011

(65) Prior Publication Data

US 2012/0297637 A1 Nov. 29, 2012

(30) Foreign Application Priority Data

Feb. 10, 2010 (CN) ..... 2010 2 0119354

(51) Int. Cl.
*F26B 5/08* (2006.01)

(52) U.S. Cl.
CPC ..... *F26B 5/08* (2013.01); *F26B 2210/10* (2013.01)
USPC ..... 34/58; 34/105; 34/218; 135/33.2; 119/850

(58) Field of Classification Search
USPC ..... 34/58, 104, 105, 201, 218, 242; 135/16, 135/33.2; 119/792, 850
See application file for complete search history.

(56) References Cited

U.S. PATENT DOCUMENTS 1,476,599 A * 12/1923 De Witt ..... 211/62
2,373,339 A * 4/1945 Roberts ..... 34/562
3,136,426 A * 6/1964 Sakuma ..... 211/62
3,820,251 A * 6/1974 Abernathy ..... 34/60
4,189,850 A * 2/1980 Dieterich et al. ..... 34/58
4,570,358 A * 2/1986 Sacerdote ..... 34/569
5,261,541 A * 11/1993 Li ..... 211/62
5,625,960 A * 5/1997 Fujita ..... 34/80
5,709,328 A * 1/1998 Ackeret ..... 224/282

(Continued)

FOREIGN PATENT DOCUMENTS

CN 2774237 Y 4/2006
CN 101016689 A 8/2007
CN 200946963 Y 9/2007
EP 2535676 A1 * 12/2012

(Continued)

*Primary Examiner* — Steve M Gravini
(74) *Attorney, Agent, or Firm* — Muncy, Geissler, Olds & Lowe, P.C.

(57) ABSTRACT

The present invention relates to a dewatering machine for umbrella, comprising a frame, a motor disposed inside the frame, a water receiving box disposed inside the frame, an elongated water throwing box disposed inside the water receiving box to accommodate the umbrella and a transmission assembly for connecting the motor and the water throwing box. The water receiving box is fixedly attached to the motor. A plurality of water-draining holes is disposed at the side of the water throwing box. The transmission assembly includes a transmission shaft fixedly attached to the bottom center of the water throwing box. The transmission shaft is perpendicular to the water throwing box. The water throwing box is disposed inside the dewatering device and connected with the motor via the transmission assembly. The water throwing box is perpendicular to the transmission shaft to enable the umbrella to rotate above the plane direction where the umbrella is perpendicular to the transmission shaft; therefore rainwater on the umbrella, especially the folding umbrella, can be thrown out of the folds under the centrifugal force. The dewatering process is rapid and efficient.

10 Claims, 2 Drawing Sheets

(56) References Cited

U.S. PATENT DOCUMENTS

| | | | | |
|---|---|---|---|---|
| 6,499,230 | B1 * | 12/2002 | Fix | 34/223 |
| 7,124,516 | B2 * | 10/2006 | Shiraishi | 34/103 |
| 2008/0182481 | A1 * | 7/2008 | Yang | 446/267 |
| 2012/0297637 | A1 * | 11/2012 | Liao | 34/58 |

FOREIGN PATENT DOCUMENTS

| | | | | | |
|---|---|---|---|---|---|
| JP | 04217778 | A | * | 8/1992 | F26B 9/00 |
| JP | 06109362 | A | * | 4/1994 | F26B 9/00 |
| JP | 2006308130 | A | | 11/2006 | |
| JP | 2008275235 | A | | 11/2008 | |

* cited by examiner

DEWATERING MACHINE FOR UMBRELLA

FIELD OF THE INVENTION

The present invention relates to a dewatering machine for umbrella.

BACKGROUND OF THE INVENTION

In rainy days, in office buildings, marketplaces, etc. with huge population, if rainwater on umbrellas drops to the ground, the ground will become slippery and people are likely to fall over. It would also cause environmental problem. In addition, it is inconvenient for people to carry wet umbrellas for shopping. In order to solve the above problem, a common solution is to put the umbrella in a bag. But if the bag is damaged, the rainwater will still drop to the ground to make it slippery.

The dewatering machine for umbrella in the prior art comprises a drying drum, into which the umbrella is placed vertically. The drying drum rotates to create the centrifugal force to dry the umbrella. As the folding umbrellas have many folds, it is difficult to completely remove the rainwater from the folds, the dewatering effect is poor. The drying drum is in the shape of a column. Generally, all long and short umbrellas can be used. Because the drying drum is in a big size, the dewatering machine has a big size too. It occupies a large area and it is inconvenient to be used.

With respect to the dewatering machine for umbrella in the prior art, umbrellas are placed vertically for dewatering. The water collecting container (water collecting disk) is disposed at the bottom and it is shaped like a funnel. The size of the water collecting disk is small and it is necessary to frequently remove the rainwater. It is inconvenient to be used and cannot be used indoors. As the umbrella is placed vertically, the drying drum needs a fastener to hold the umbrella so as to protect the umbrella from being damaged during the drying process.

Generally, dewatering machine for umbrella is large and an AC power supply is required. But in actual applications, the dewatering machines are mainly placed outdoors and it is inconvenient to use an external AC power supply.

SUMMARY OF THE INVENTION

In view of the above-described problems, it is one objective of the present invention to provide a dewatering machine for umbrella, which can rapidly and effectively remove rainwater on umbrellas.

To achieve the above objective, the present invention adopts the following solution: a dewatering machine for umbrella, comprising a frame, a motor disposed inside the frame, a water receiving box disposed inside the frame, an elongated water throwing box disposed inside the water receiving box to accommodate the umbrella and a transmission assembly for connecting the motor and the water throwing box. The water receiving box is fixedly attached to the motor. A plurality of water-draining holes is disposed at the side of the water throwing box. The transmission assembly includes a transmission shaft fixedly attached to the bottom center of the water throwing box. The transmission shaft is perpendicular to the water throwing box.

As an improvement, the dewatering machine for umbrella further comprises a plurality of first elastic members, a plurality of second elastic members and a support fixedly disposed inside the frame. The water receiving box is connected with the frame via the first elastic member and the motor is connected with the support via the second elastic member.

As an improvement, the first elastic member is connected with the top of the frame.

As an improvement, the first elastic member and the second elastic member are springs.

As an improvement, the transmission assembly includes a power output shaft and a brake/clutch device. The water throwing box, the power output shaft, the brake/clutch device and the motor are sequentially connected with one another.

As an improvement, the brake/clutch device is fixedly connected with the motor and the water receiving box, respectively.

As an improvement, the power output shaft passes through the water receiving box. A water barrier is disposed between the power output shaft and the water receiving box. The water barrier is a rubber cup.

As an improvement, the water throwing box is an elongated box, whose two ends are oppositely disposed with limit end-plates with the same distance and the limit end-plates are symmetrically disposed at two sides of the center of gravity of the water throwing box.

As an improvement, the limit end-plate is disposed with a plurality of water-draining holes.

As an improvement, the limit end-plate is a V-shaped folded plate.

As an improvement, the side of the water throwing box is disposed with water-draining holes.

As an improvement, the dewatering machine for umbrella further comprises an electrically connected battery pack for the motor and the battery pack is at the bottom of the frame.

As an improvement, the dewatering machine for umbrella further comprises a flexible water discharge pipe and a water collecting box at the lower part of one inner side of the frame. The bottom of the water receiving box is disposed with a water discharge vent and the water collecting box is connected with the water discharge vent via the flexible water discharge pipe.

Advantages of the present invention are summarized below: the water throwing box is disposed inside the dewatering machine for umbrella and connected with the motor via the transmission assembly. The water throwing box is perpendicular to the transmission shaft to enable the umbrella to rotate above the plane direction where the umbrella is perpendicular to the transmission shaft; therefore rainwater on the umbrella, especially the folding umbrella, can be thrown out of the folds under the centrifugal force. The dewatering process is rapid and efficient.

DETAILED DESCRIPTION OF THE EMBODIMENTS

The present invention is described in further detail below with reference to the accompany drawings.

Figure 1:
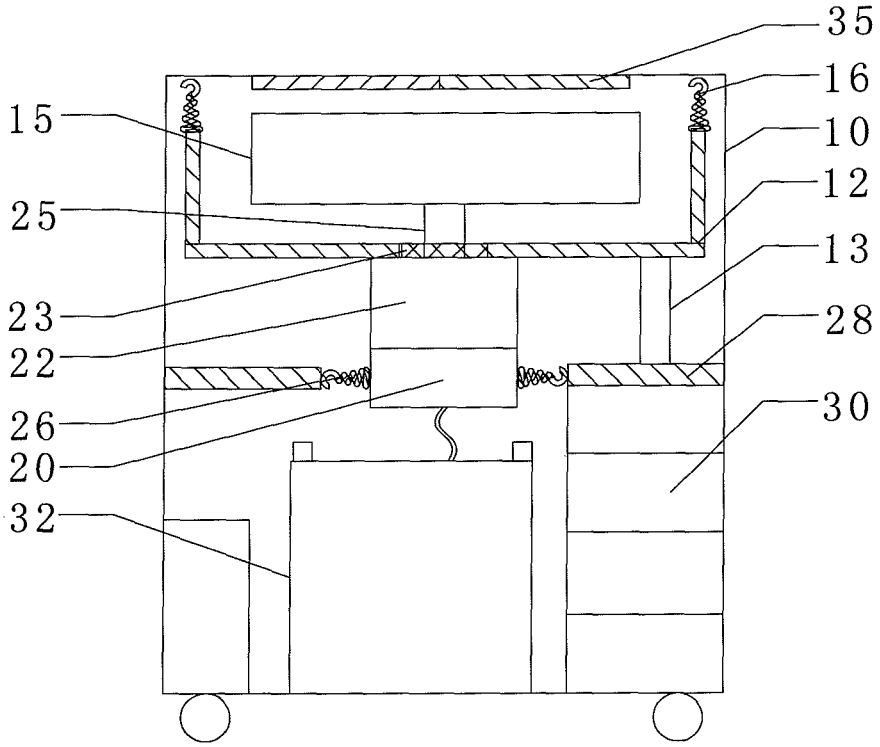
FIG. 1 is a structural representation of one embodiment of a dewatering machine for umbrella of present invention.

As shown in FIG. 1, a dewatering machine for umbrella, in accordance with the present invention, comprises a frame 10, a motor 20 disposed inside the frame 10, a water receiving box 12 disposed inside the frame 10, an elongated water throwing box 15 disposed inside the water receiving box 12 to accommodate the umbrella and a transmission assembly for connecting the motor 20 and the water throwing box 15. The water receiving box 12 is fixedly attached to the motor 20. A plurality of water-draining holes is disposed at the side and two ends of the water throwing box 15. The transmission assembly includes a transmission shaft 25 fixedly attached to the bottom center of the water throwing box 15. The transmission shaft 25 is perpendicular to the water throwing box 15. The frame 10 may be a machine case to accommodate various members of the machine. The transmission shaft 25 is a power output shaft.

The water throwing box 15 is disposed inside the dewatering machine for umbrella, is perpendicular to the transmission shaft 25 and connected with the motor 20 via the transmission assembly. When the motor 20 is started, the water throwing box 15 rotates with the output shaft of the motor 20. The umbrella/folding umbrella is also disposed inside the water throwing box 15 and perpendicular to the transmission shaft 25. It allows the umbrella to rotate on the plane direction where the umbrella is perpendicular to the transmission shaft 25. As a result, rainwater can be thrown out of the folds of umbrellas, especially folding umbrellas, under the centrifugal force and rapid dewatering is achieved. The water receiving box 12 also serves as a connecting part for the motor 20 and the water throwing box 15 to provide auxiliary connection.

The top of the dewatering machine for umbrella is disposed with a door 35, which can be opened to change umbrellas for dewatering.

Figure 2:
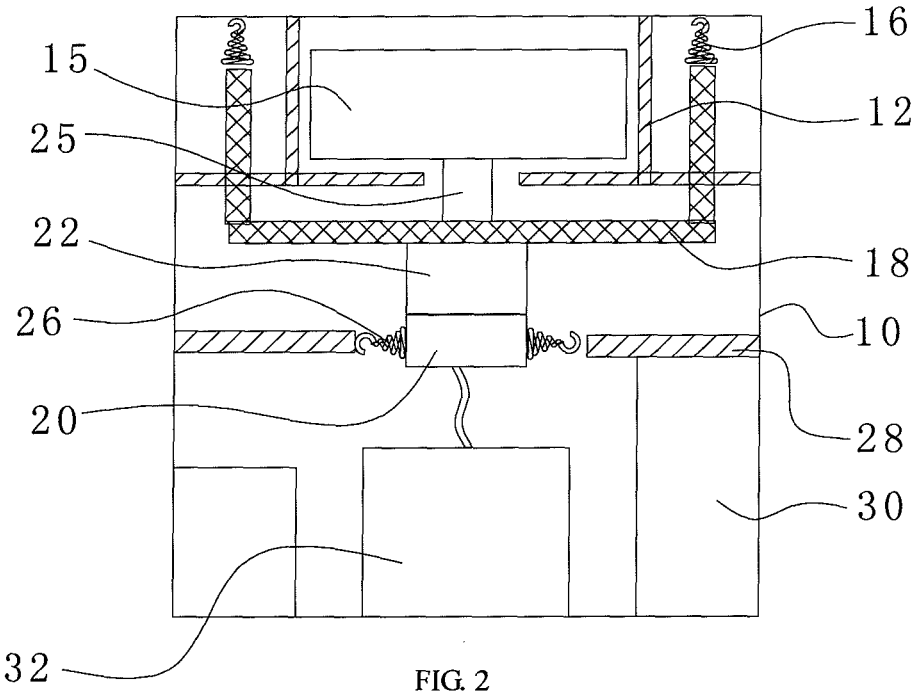
FIG. 2 is a structural representation of another embodiment of the dewatering machine for umbrella of present invention.

Preferably, the dewatering machine for umbrella further comprises a plurality of first elastic members 16, a plurality of second elastic members 26 and a support 28 fixedly disposed inside the frame 10. The water receiving box 12 is connected with the frame 10 via the first elastic member 16 and the motor 20 is connected with the support 28 via the second elastic member 26. As shown in FIG. 2, a hanger 18 can be disposed inside the dewatering machine for umbrella. The hanger 18 is connected with the motor 20 and the water throwing box 15, and then connected with the frame 10 via the first elastic member 16. The water receiving box 12 is fixedly connected with the frame 10. As a member to collect different umbrellas, the hanger 18 replaces the water receiving box for auxiliary connection. Because weight of umbrellas is different, the centrifugal force varies during the dewatering process to create intense vibration for the water throwing box 15 and the water receiving box 12. The water receiving box 12, the motor 20, the transmission assembly and the water throwing box 15 can be seen as a whole. After the hanger 18 or the water receiving box 12 is connected with the frame 10 via the first elastic member 16, the water throwing box 15 and the motor 20 are in a suspended state. The elastic members are used to absorb the vibration of the water throwing box 15 to prevent the vibration from passing to the frame 10.

On the other hand, as the axle distance between the water throwing box 15 and the motor 20 is large, when the upper water throwing box 15 slightly swings, the lower motor 20 will vibrate violently. Consequently, when the water throwing box 15 vibrates, the motor 20 will vibrate violently. It will affect the lifespan of the motor 20 and increase abrasion of different elements of the dewatering machine. For this reason, the second elastic members 26 are provided to allow the motor 20 to connect with the support 28 in the frame 10. The second elastic members 26 support the motor 20 and can reduce vibration. In other words, as the three points are evenly disposed along the circumferential direction of the motor, the motor 20 is positioned and its vibration is controlled within a smaller range. The motor 20 and the transmission assembly slightly swing within a safe range. Meanwhile, due to the effect of the counterforce, the swing of the water throwing box 15 is also reduced.

Preferably, the first elastic member 16 is connected with the top of the frame 10. The lower the connected position between the water receiving box 12 or the hanger 18 and the frame 10, the bigger the vibration of the first elastic member 16 under the direct centrifugal force, and the larger the swing amplitude of the first elastic member 16. It is easy to cause aging and damage of the first elastic member 16. Additionally, the higher the connected position between the water receiving box 12 or the hanger 18 and the frame 10 (close to the top of the frame 10), the lower the vibration of the first elastic member 16 under the direct centrifugal force. Because the water receiving box 12 or the hanger swing in a certain range, the vibration is absorbed by the first elastic member 16 and cannot be passed to the frame 10. It prolongs the lifespan of the elastic members and the dewatering machine for umbrella.

Preferably, the first elastic member 16 and the second elastic member 26 are springs. The first elastic member 16 is an extension spring while the second elastic member 26 may be an extension spring or a compression spring. The elastic members, i.e. the springs, is used to absorb vibration when the dewatering machine for umbrella is running so as to prevent the vibration from passing to the frame 10. Consequently, the lifespan of the dewatering machine is prolonged.

Preferably, the transmission assembly includes a power output shaft 25 and a brake/clutch device 22. The water throwing box 15, the power output shaft 25, the brake/clutch device 22 and the motor 20 are sequentially connected with one another. As umbrellas need to be changed from time to time during the dewatering process, the water throwing box rotates and stops alternately, the brake device functions to stop the water throwing box 15, but it would easily cause unbalance of the water throwing box 15 and increase vibration when it rotates. Meanwhile, when the water throwing box stops abruptly, the water throwing box 15 is likely to be cracked or damaged to affect lifespan of the dewatering machine. The preferred braking method is to stop the output shaft. The braking effect is more perfect and stable. Damage to the other elements is minimized. The braking methods include pneumatic, by drum or electromagnetic. The braking effect is better when the output shaft is stopped electromagnetically. The output shaft can be stopped promptly when the elements are controlled by circuit.

On the other hand, if the output shaft is started or stopped instantly, it would affect the lifespan of the motor 20, which requires a certain amount of starting time when the motor 20 is from rest to peak. If the motor 20 is started frequently, the usage time is increased. If the starting rotation is slow, it would affect the dewatering effect and when it is stopped in an emergency, the motor 20 stops rotation to cause severe abrasion. As a result, in order to avoid frequent start and stop of the motor 20, a clutch device is added to be used together with the brake device. The brake device and the clutch device are closely linked with each other. When the brake is applied, the motor's rotating shaft and output shaft are separated automatically by means of the clutch device while the brake device applies emergency brake on the output shaft and the motor's rotating shaft continues to rotate. When the motor is used again, the rotating shaft and the output shaft are connected by means of the clutch device. The force is transmitted to the water throwing box to make it rotate rapidly. The slow motor's rotation speed and long starting time are avoided while the dewatering machine is continuously used.

Preferably, the brake/clutch device 22 is fixedly connected with the motor 20 and the water receiving box 12, so that the motor 22, brake/clutch device 22, water throwing box 15 and the water receiving box 12 are connected as a whole and disposed inside the frame 10 in a suspended state by means of the elastic members. When the dewatering device stops, the motor 20, the brake/clutch device 22, the water throwing box 15 and the water receiving box 12 are fixedly connected as a whole.

Preferably, the power output shaft 25 passes through the water receiving box 12. A water barrier 23 is disposed between the power output shaft 25 and the water receiving box 12. The water barrier 23 is a rubber cup to prevent the umbrella from entering into the motor 20; the brake/clutch device 22 and a battery pack 32 from the gap at the connection position so as to damage the related parts.

Figure 3:
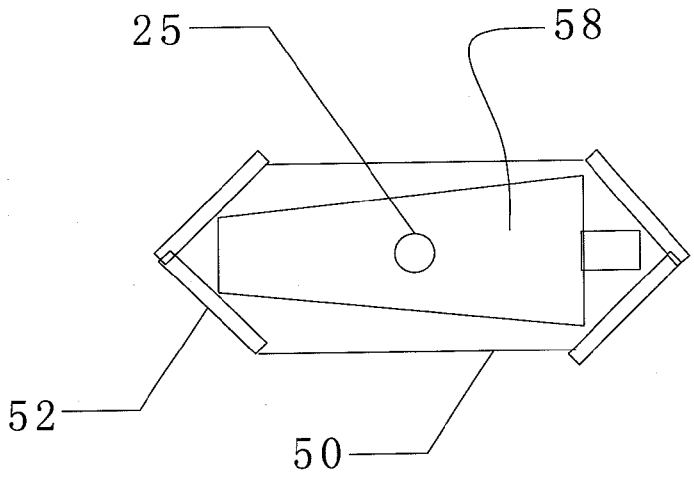
FIG. 3 is a structural representation of a first water throwing box.
Figure 4:
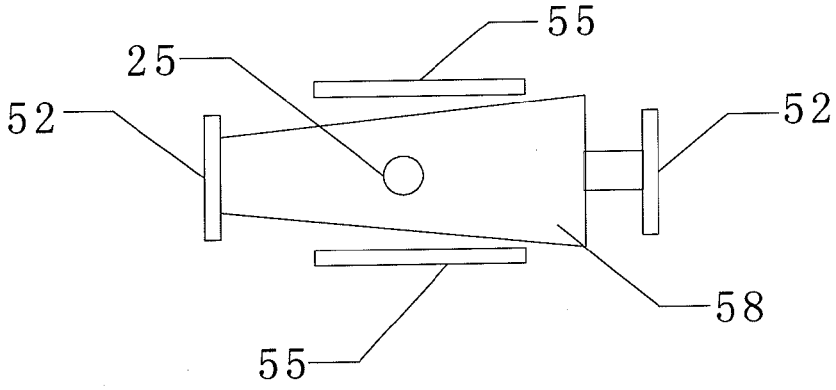
FIG. 4 is a structural representation of a second water throwing box.

Preferably, as shown in FIGS. 3 and 4, the water throwing box 15 is an elongated box, whose two ends are oppositely disposed with limit end-plates 52 with the same distance and the limit end-plates 52 are symmetrically disposed at two sides of the center of gravity of the water throwing box 15. In order to reduce vibration during the dewatering process, the umbrella should be placed in the center with the output shaft as the center. Consequently, the water throwing box should allow the umbrella to be placed in the center to avoid vibration. For that reason, a front baffle and a rear baffle can be added. The front and rear baffles use the output shaft as the center to move oppositely with equal distance. Therefore, we can adjust the distance between the front and rear baffles to accommodate different types of umbrellas. After the umbrella is placed in the center, the front and rear baffles can be fixed by a fastener. The front and rear baffles are limit end-plates. In order to further ensure the umbrella is placed in the center, a left and right baffle 55 can be added using the output shaft as a center to move oppositely with equal distance.

Preferably, the limit end-plate 52 is a V-shaped folded plate, so that the limit end-plates 52 at the two ends are only required to limit an umbrella 58 to ensure that the umbrella 58 is at the central position of the water throwing box.

Preferably, the limit end-plate 52 is disposed with a plurality of water-draining holes to further improve water discharge capacity of the water throwing box 15.

Preferably, the sides of the water throwing box 15 are disposed with water-draining holes to further improve water discharge capacity of the water throwing box 15.

Consequently, the front/rear ends, sides and the bottom of the water throwing box 15 are disposed with water-draining holes. When the water throwing box 15 rotates, the rainwater is discharged from the water-draining holes under the centrifugal force.

Preferably, the dewatering machine for umbrella also comprises an electrically connected battery pack 32 for the motor and the battery pack 32 is at the bottom of the frame 10. The dewatering machine for umbrella further comprises the electrically connected battery pack 32 for the motor 20 to provide enough power for the dewatering machine. AC power supply is not necessary, the usage place is not limited, and it can be used outdoors without AC power supply. The battery pack 32 is disposed at the bottom of the frame 10. The dewatering machine for umbrella can be designed smaller to accommodate folding umbrellas, i.e. shorter umbrellas, to save materials and space. The water throwing box 15 is disposed at the top for convenient use. The bottom of the water throwing box is left with enough space to accommodate the battery pack 32 without extra space required. The water throwing box is horizontally placed, more space is saved and the dewatering efficiency becomes higher without overcoming the gravity.

Preferably, the dewatering machine for umbrella further comprises a flexible water discharge pipe 13 and a water collecting box 30 at the lower part of one inner side of the frame 10. The bottom of the water receiving box 12 is disposed with a water discharge vent and the water collecting box 30 is connected with the water discharge vent via the flexible water discharge pipe 13. When the water throwing box 15 rotates, the water drops to the water receiving box 12 under the centrifugal force, flows out of the water discharge vent and enters into the water collecting box 30 along the flexible water discharge pipe 13.

The umbrella is placed in horizontal direction for dewatering and the height occupied along the vertical direction is small. More space can be reserved to collect water. Therefore the water storage capacity is further improved. It is not required to discharge the water frequently and the water discharge cycle is improved. The water throwing box 15 is horizontally to save more space and increase water storage capacity.

A waterproof and insulating water barrier 23, e.g. rubber cup, is disposed between the water receiving box 12 and the transmission assembly so as to prevent water in the water receiving box 12 from entering into the motor and the batter pack 32 and prevent water from dropping to the motor 20 and the battery pack 32 to cause creepage.

The water throwing box 15 can be disposed side by side with two or more grids. Two or more umbrellas 58 can be placed for dewatering to improve dewatering efficiency. It is suitable for areas with rapid people flow. In order to reduce the size of the frame 10, the water throwing box 15 can also be disposed up and down with two or more grids to improve dewatering efficiency.

The above description only show the preferred embodiment of the present invention and it is not used to limit the scope of the invention. It should be understood that changes and modifications made without departing from the invention in its broader aspects fall within the true spirit and scope of the invention.

What is claimed is:

1. A dewatering machine for a foldable umbrella, comprising:

a frame;

a motor disposed inside the frame;

a water receiving box disposed inside the frame;

a water throwing box disposed inside the water receiving box to accommodate the umbrella, the water throwing box having an axis along which the umbrella is disposed;

a transmission assembly for connecting the motor and the water throwing box, the water receiving box being fixedly attached to the motor; and a plurality of water-draining holes disposed at sides of the water throwing box, wherein the transmission assembly includes a transmission shaft fixedly attached to the bottom center of the water throwing box, and wherein the transmission shaft is perpendicular to the axis of the water throwing box, such that the foldable umbrella is rotated in a plane perpendicular to the transmission shaft.

2. The dewatering machine of claim 1, further comprising:

a plurality of first elastic members;

a plurality of second elastic members; and a support fixedly disposed inside the frame, wherein the water receiving box is connected with the frame via the first elastic member and the motor is connected with the support via the second elastic member.

3. The dewatering machine of claim 2, wherein the first elastic member is connected to a top of the frame.

4. The dewatering machine of claim 2, wherein the first elastic member and the second elastic member are springs.

5. The dewatering machine of claim 1, wherein the transmission assembly includes a power output shaft and a brake/clutch device, and wherein the water throwing box, the power output shaft, the brake/clutch device and the motor are sequentially connected with one another.

6. The dewatering machine of claim 1, wherein the water throwing box is an elongated box, and two ends of the elongated box are oppositely disposed with limit end-plates and the limit end-plates are symmetrically disposed at two sides of the center of gravity of the water throwing box.

7. The dewatering machine of claim 6, wherein the limit ends plates are disposed with a plurality of water-draining holes.

8. The dewatering machine of claim 1, wherein the limit ends plates are V-shaped folded plates.

9. The dewatering machine of claim 1, further comprising an electrically connected battery pack for the motor and the battery pack is at the bottom of the frame.

10. The dewatering machine of claim 1, further comprising:

a flexible water discharge pipe; and a water collecting box at the lower part of one inner side of the frame, wherein the bottom of the water receiving box is disposed with a water discharge vent and the water collecting box is connected with the water discharge vent via the flexible water discharge pipe.

* * * * *